United States Patent [19]

Ovitz, III

[11] 4,197,950

[45] Apr. 15, 1980

[54] DISPLAY SHELF ASSEMBLY

[75] Inventor: Ernest G. Ovitz, III, Galva, Ill.

[73] Assignee: John H. Best and Sons, Inc., Galva, Ill.

[21] Appl. No.: 923,948

[22] Filed: Jul. 13, 1978

[51] Int. Cl.[2] ..... A47F 7/16

[52] U.S. Cl. ..... 211/134; 211/45; 211/187

[58] Field of Search ..... 211/134, 45, 55, 187, 211/128, 133; 248/243, 247, 242, 248; 108/108

[56] References Cited

U.S. PATENT DOCUMENTS

| | | | |
|---|---|---|---|
| 2,681,786 | 6/1954 | Sparring | 248/243 |
| 2,960,761 | 11/1960 | Preader | 248/248 X |
| 3,085,693 | 4/1963 | Shell | 248/248 X |
| 3,097,746 | 7/1963 | Handler et al. | 108/108 X |
| 3,101,681 | 8/1963 | Streater | 211/187 X |
| 3,185,426 | 5/1965 | Bjerke | 211/187 X |
| 3,534,863 | 10/1970 | Howard | 211/133 X |

FOREIGN PATENT DOCUMENTS

| | | | |
|---|---|---|---|
| 2132751 | 1/1973 | Fed. Rep. of Germany | 211/134 |
| 1025018 | 4/1966 | United Kingdom | 211/187 |

*Primary Examiner*—William H. Schultz
*Assistant Examiner*—Robert W. Gibson, Jr.
*Attorney, Agent, or Firm*—Kinzer, Plyer, Dorn & McEachran

[57] ABSTRACT

A display shelf having a front lip and a pair of side arms defining a three sided enclosure for supporting an inside panel; brackets at the ends of the arms serve to cantilever the shelf on a pair of support bars.

3 Claims, 8 Drawing Figures

10
12
22
30
14
64
24
26
64
32
16
28
60
18

34
24
48
A
-40-
66
42
36

66
46
44
42 fig.3.
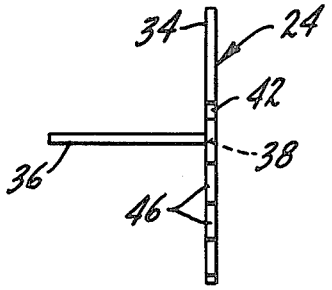
fig.5.
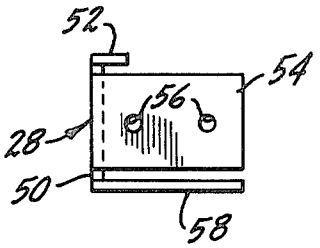
fig.4.
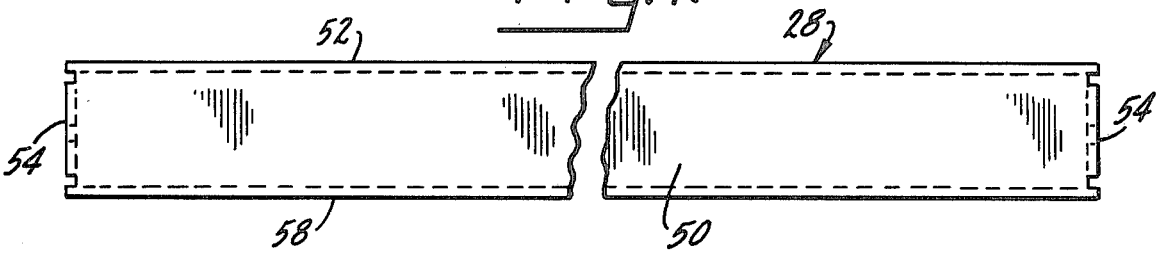
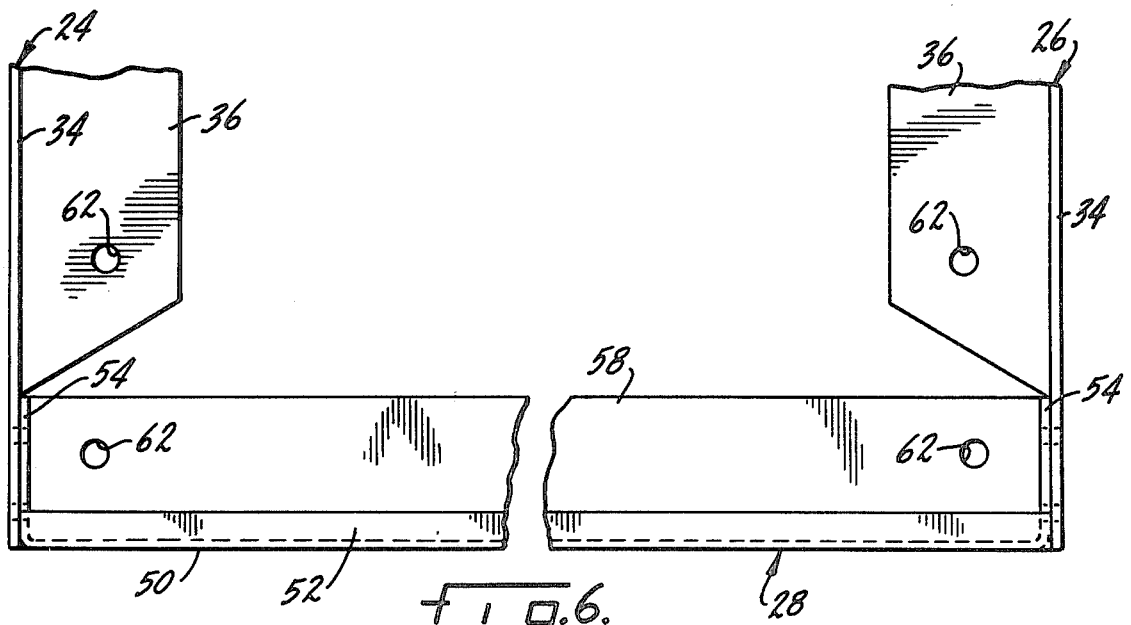
fig.6.

DISPLAY SHELF ASSEMBLY

This invention relates to a display shelf adapted to be removably suspended in one of several selective positions.

The preferred embodiment of the invention will be described in terms of displaying carpet samples for retail trade but the shelf may be used equally well to display tile samples, wall panel samples, wall paper samples and so on.

The objects of the invention are to construct an inexpensive but nonetheless sturdy sample display shelf, to so construct the shelf that it may be supported with several others in a tier on a wall or a stand at an angle so the customer may easily glance at and handle several samples for comparison, and to so construct the shelf that samples may be displayed attractively as a feature of customer appeal.

In the drawing:

FIG. 3 is an end view of the side arm shown in FIG. 2;

FIG. 4 is an elevation of the front lip;

FIG. 5 is an end view of the front lip;

FIG. 6 is a fragmentary assembly view;

Figure 1:
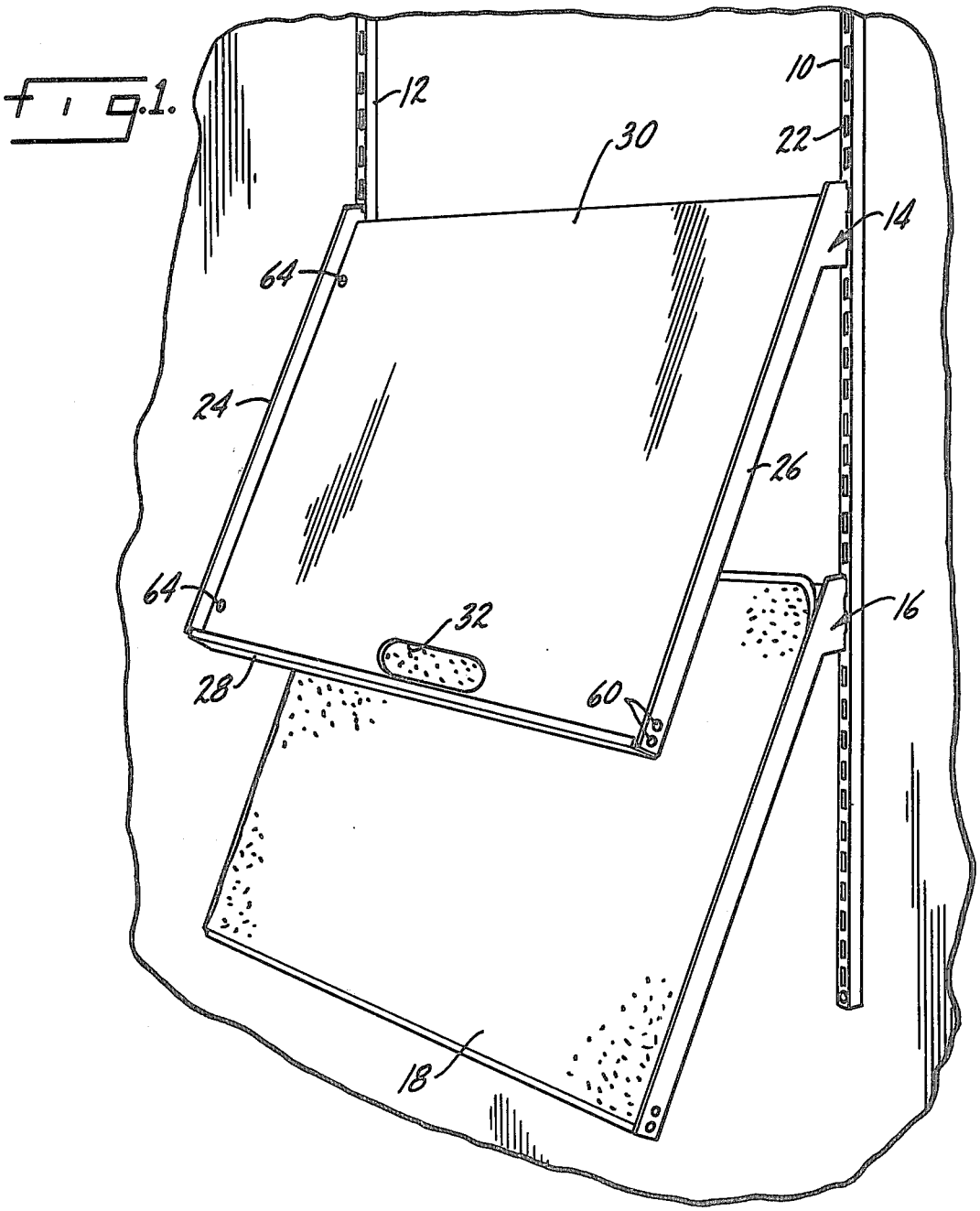
FIG. 1 is a perspective view of a display assembly conforming to the present invention.

A shelf assembly constructed in accordance with the present invention is shown in FIG. 1, comprising a pair of parallel, laterally spaced upright channel support members 10 and 12, which may be fastened to an interior (shop) wall and detachably supporting a pair of identical shelf members 14 and 16.

The shelf members 14 and 16 are supported at an outwardly and downwardly inclined angle and can be selectively spaced one above the other so the displayed samples may be easily compared. A carpet sample 18 is removably supported by shelf 16 but the sample may be something other than a carpet sample.

The support bars or members 10 and 12 are identical. Each is in the form of an elongated metal channel extrusion secured to the wall as by screws. The outer surface of each support bar is provided with vertically spaced, elongated hook-receiving slots 22.

The shelves 14 and 16 are identical. Each comprises a pair of laterally spaced, elongated side arm members 24 and 26 joined at their front ends by a transverse lip member 28, defining a three-sided enclosure space in which is supported a flat shelf 30, preferably a cardboard panel. The panel 30 preferably has a cut-out opening 32 at the front so a person can reach beneath and lift out the front edge of the carpet sample to remove it.

Figure 2:
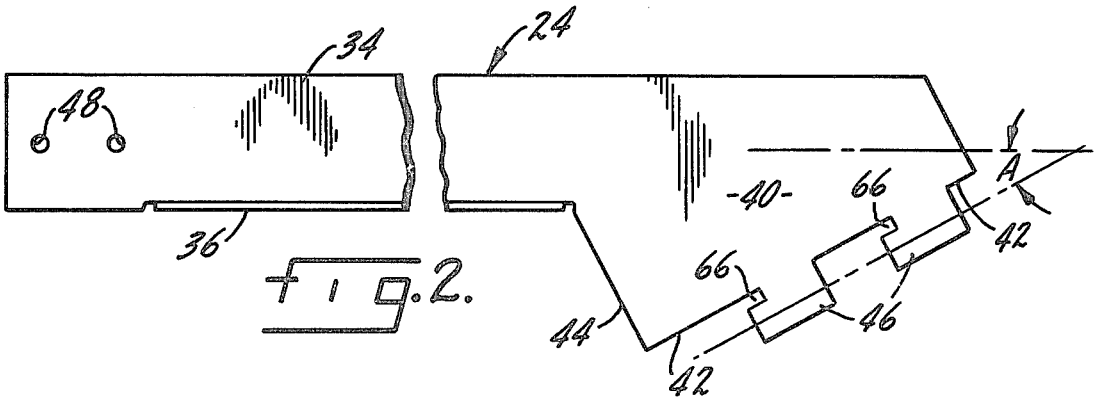
FIG. 2 is an elevation, broken away, of a side arm.
Figure 8:
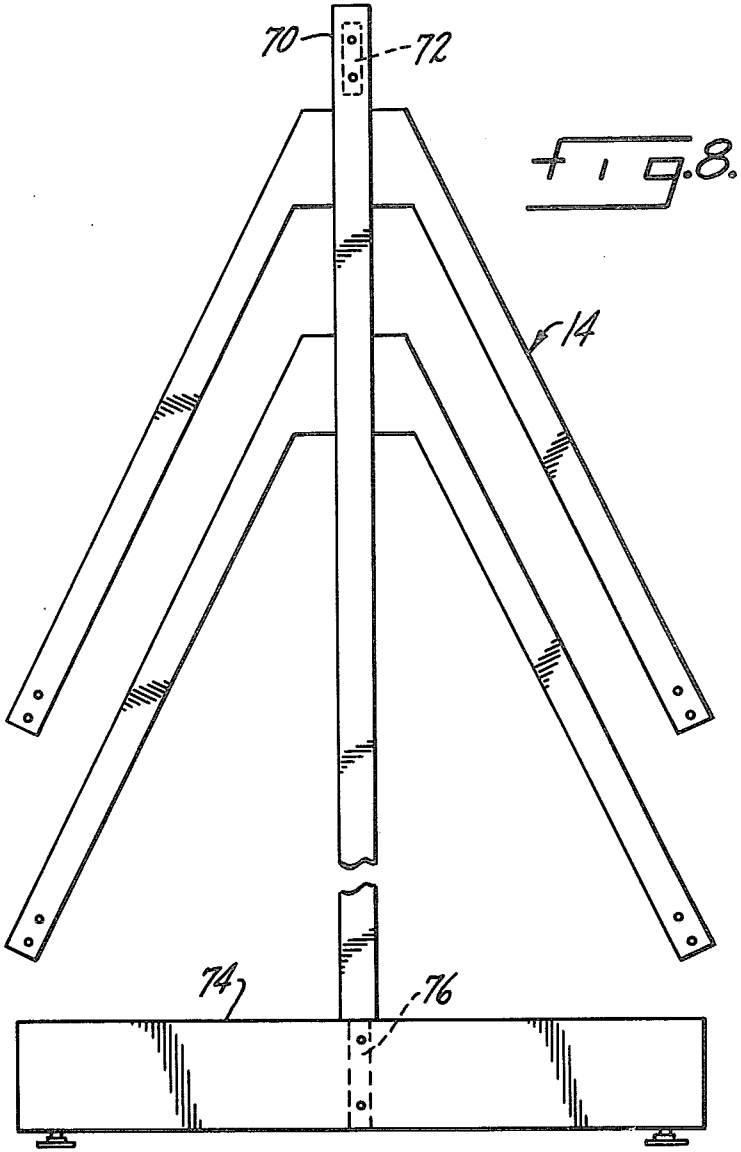
FIG. 8 is an end view of the assembly shown in FIG. 7.

The left hand side arm 24 (FIG. 1) is shown in detail in FIGS. 2 and 3. It is preferably an aluminum stamping and comprises a flat upright side plate 34 having at the lower edge a panel support flange 36 bent inwardly, as shown in FIG. 3, along a fold line 38.

At the end to be hooked to the related support bar, the side arm 24 is so stamped as to present an enlarged lug or ear 40. The top edge of the lug 40 is a straight extension of the top edge of the side plate 34 but the lower edge 42 is off-set downwardly a considerable distance at 44. A pair of hooks 46 projecting from the lower edge 42 are spaced to fit two adjacent slots in the support bars.

The hooks are aligned on an axis which when projected rearwardly intercepts the projected axis (dashed line) of the side plate at an acute included angle A which may be approximately 30°.

The front end of the side arm member is provided with a pair of apertures 48.

The right hand side arm member 26 is identical including; of course, an inwardly bent panel support flange.

The front lip member 28 is also preferably an aluminum stamping, FIGS. 4 and 5. It presents a front lip plate 50 having an inwardly bent retainer rib 52 on the upper edge. An inwardly bent ear 54 is provided at each end of the front lip member. Each ear has a pair of apertures 56. An inwardly bent panel support flange 58 is provided at the lower edge of the front lip member.

To join and rigidify the side arms, the ears 54 are presented to the inside surfaces of the side arm plates, FIG. 6, and rivet-type fasteners 60, FIG. 1, are passed through the pairs of aligned apertures 48 and 56.

As shown in FIG. 6, the panel support flanges are apertured at 62 to receive fasteners 64 which secure the panel 30 thereto, completing the shelf.

The side arms are not joined at the rear. This allows a degree of flexibility when aligning the hooks to the bar slots for a quick, easy slide fit. Since the hook on a shelf may be presented to any adjacent pair of slots, it is possible to select a preferred display spacing arrangement between adjacent shelves.

By having a pair of hooks, especially those shown which afford a bayonet-type slide fit, there is assurance of a relatively rigid cantilever joint between the support bars and enclosure arms. In this connection it will be appreciated that the solid portions of the vertical support bars bordering the slots 22 fit into the notches 66, FIG. 2, afforded by the hooks and are thereby captured. At the same time, the lower inclined edge 42 of the bracket 40 bears against the outer surface of the support bar to support the shelf as a whole so that it is the edge 42 of the bracket which results in the cantilever support principle, the hooks 46 merely serving to prevent displacement. Accordingly, while the alignment axis of the hooks 46 in the preferred embodiment may be considered as defining the suspension angle A, edge surface 42 produces the same angle since the hook axis is parallel thereto.

The display assembly may also be floor supported in which event the upright bars are joined by spacers and, at their lower ends, are secured to cross legs in a self-standing arrangement.

Figure 7:
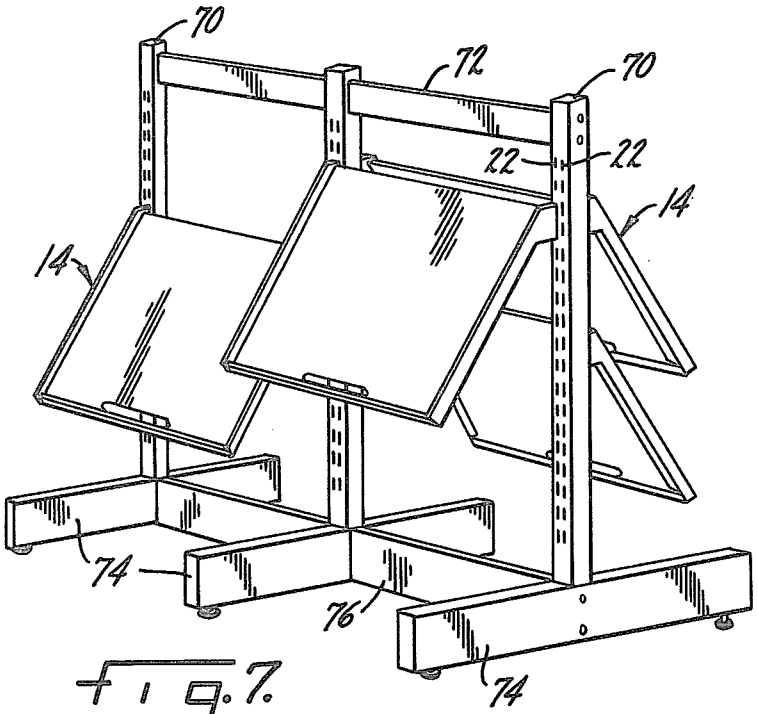
FIG. 7 is a perspective view of a floor-mounted display stand in accordance with the present invention.

Thus, as shown in FIG. 7, upright bars or posts 70 selectively support the shelves 14 in a manner identical to that described above, the shelves 14 themselves also being identical to the construction described above in detail.

There may be two or more upright bars 70 spaced and stabilized by upper cross arms 72 detachably connected to the inner faces of the uprights 70 in any desired manner. The lower ends of the uprights 70 may be detachably connected in like fashion to cross legs 74 extending at right angles to the axes of the uprights, parallel to the floor. Preferably there are additional cross arms or braces 76 detachably connected to and between the cross legs 74.

The attaching slots 22 are in double rows along the length of each bar 70 so that laterally adjacent shelves may be selectively hung on three uprights and this feature may also be employed in the instance of wall-mounted uprights.

As can be seen in FIGS. 1 and 7 the shelf member 18 is supported by the flanges 36 and 58, in a plane well beneath the upper edges of the side plates 34 and the front lip 28 so that the carpet sample 18 is nested within (walled in by) the enclosure defined by the side plates and front lip.

I claim:

1. A carpet display shelf assembly comprising, at least three elongated support bars supported in a parallel upright relation, said bars each being provided with a double row of selectable bracket support slots, a pair of laterally spaced elongated side arm members of stamped metal each presenting a side plate having an attaching bracket at one end with at least a pair of hooks formed thereon to slidably fit into a corresponding pair of slots in adjacent support bars, a front lip member of stamped metal joined at the ends thereof to the ends of said side plates opposite the brackets thereby to afford a three-sided enclsoure, said pair of hooks on each side plate bracket being aligned on an axis which when extended in the direction of said bars intercepts the likewise extended axis of the related side plate at an acute included angle, said plates and lip each having a shelf supporting flange bent inwardly therefrom along a fold line at the lower edge thereof and which collectively afford a three-sided support frame for a flat shelf inside the enclosure, said suport frame being located beneath the upper edges of the side plates and front lip so that a carpet sample will be walled in by the enclosure defined by said side plates and front lips, and a flat piece of shelving supported by said support frame to constitute the shelf, said double rows of support slots enabling at least two of said three-sided support frames and related shelving to be hook-supported in laterally adjacent relation by the three support bars.

2. An assembly according to claim 1 in which the three members are joined by ears integral with a related member.

3. An assembly according to claim 1 or 2 in which the flanges have openings therein and in which said shelving is a flat piece of cardboard fastened to said flange openings.

* * * * *